United States Patent [19]

Ketteringham

[11] 4,205,741

[45] Jun. 3, 1980

[54] ANTI-CHEAT MECHANISM FOR COIN ACTUATED VENDING MACHINE

[76] Inventor: Terence T. Ketteringham, 7, St. Augustines Rd., Wisbech, Cambridgeshire, England

[21] Appl. No.: 946,066

[22] Filed: Sep. 27, 1978

[30] Foreign Application Priority Data

Oct. 11, 1977 [GB] United Kingdom ..... 42273/77

[51] Int. Cl.[2] ..... G07F 11/20

[52] U.S. Cl. ..... 194/39

[58] Field of Search ..... 194/37, 39, 68, 32, 194/41

[56] References Cited

U.S. PATENT DOCUMENTS 703,621 7/1902 Sweeney ..... 194/39

*Primary Examiner*—Stanley H. Tollberg

*Attorney, Agent, or Firm*—Frost & Jacbos

[57] ABSTRACT

A coin freed vending machine for coins and/or goods, which comprises a coin acceptance device co-acting with a stop device to provide an anti-cheat mechanism, the coin acceptance device consisting of a coin bucket mounted on one end of a see-saw member, the other end of which co-acts with the stop device to prevent unauthorized movement of a slide or drawer for delivering the coins and/or goods. The machine also includes coin lock-out mechanism to prevent jamming of the machine with coins in excess of requirements, and also a coin hopper to facilitate filling of one or more coin storage tubes.

18 Claims, 13 Drawing Figures

ANTI-CHEAT MECHANISM FOR COIN ACTUATED VENDING MACHINE

This invention relates to coin freed vending machines, and primarily to such machines which are mechanically operated. A coin freed vending machine is defined as a vending machine which is actuated by the insertion of one or more coins, as distinct from machines which are actuated by pull levers, handles or buttons.

The term "coin" is intended to include coins of the realm and metal or other tokens, and the term "vending machines" is intended to include machines for delivering goods only for the correct denomination of coin or coins; machines for delivering goods and change simultaneously; change machines for delivering coins of a smaller denomination for a coin or coins of a larger denomination; and change machines for delivering a coin or coins of a larger denomination in exchange for coins of a smaller denomination.

The invention is particularly concerned with a machine of the kind disclosed in prior British Pat. No. 1,207,127 but which is additionally adapted to deliver goods, the machine having vertically disposed tubular guides for storing coins and/or goods and at least one dispensing means in the form of one or more slides or drawers for delivering said coins and/or goods. The machine also includes a coin acceptance device which, together with a stop member, provides anit-cheat means. In practice, it has been found that the aforementioned anti-cheat means are not foolproof in that, if a user were to jerk the slide or drawer sharply backwards and forwards, the coin acceptance device could be made to bounce and thereby result in inaccurate operation of the machine to the extent that coins and/or goods could be illegally removed from the machine.

It is therefore among the objects of the present invention to provide a coin-freed vending machine having improved anti-cheat means.

It is further among the objects of the invention to provide improved means for rejecting coins in excess of those required for a single operation of the machine.

It is still further among the objects of the invention to provide improved means for preventing the insertion of coins into the machine when the store of coins and/or goods is exhausted.

According to the present invention, there is provided a coin freed vending machine, comprising storage means for coins and/or goods, a slide or drawer for delivering the coins and/or goods, and a coin acceptance device co-acting with a stop device to provide anti-cheat means, wherein the coin acceptance device comprises a see-saw member having a coin bucket and control arm which member is tiltable and is positioned to co-act with the stop device to control movement of the slide or drawer, the stop device having first gate means to permit passage therethrough of a part of the see-saw member in one direction only, and second gate means to permit passage therethrough of said part of the see-saw member in the opposite direction only.

Figure 1:
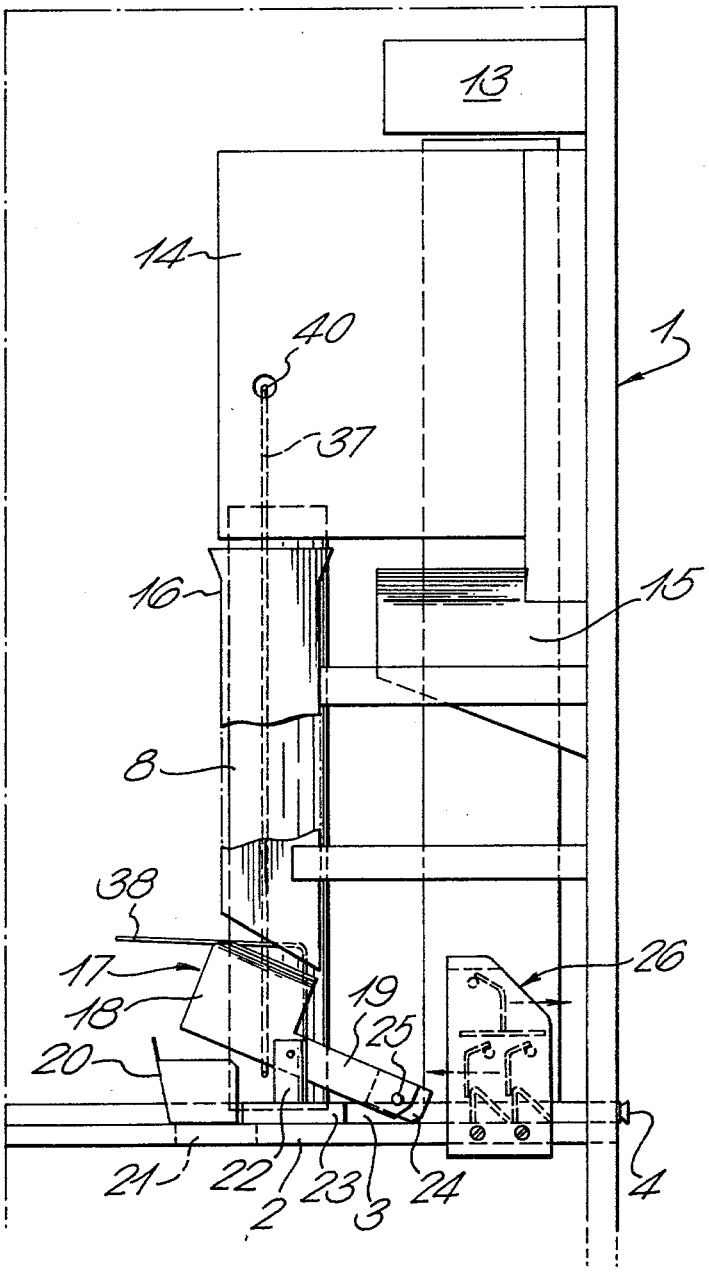
Figure 2:
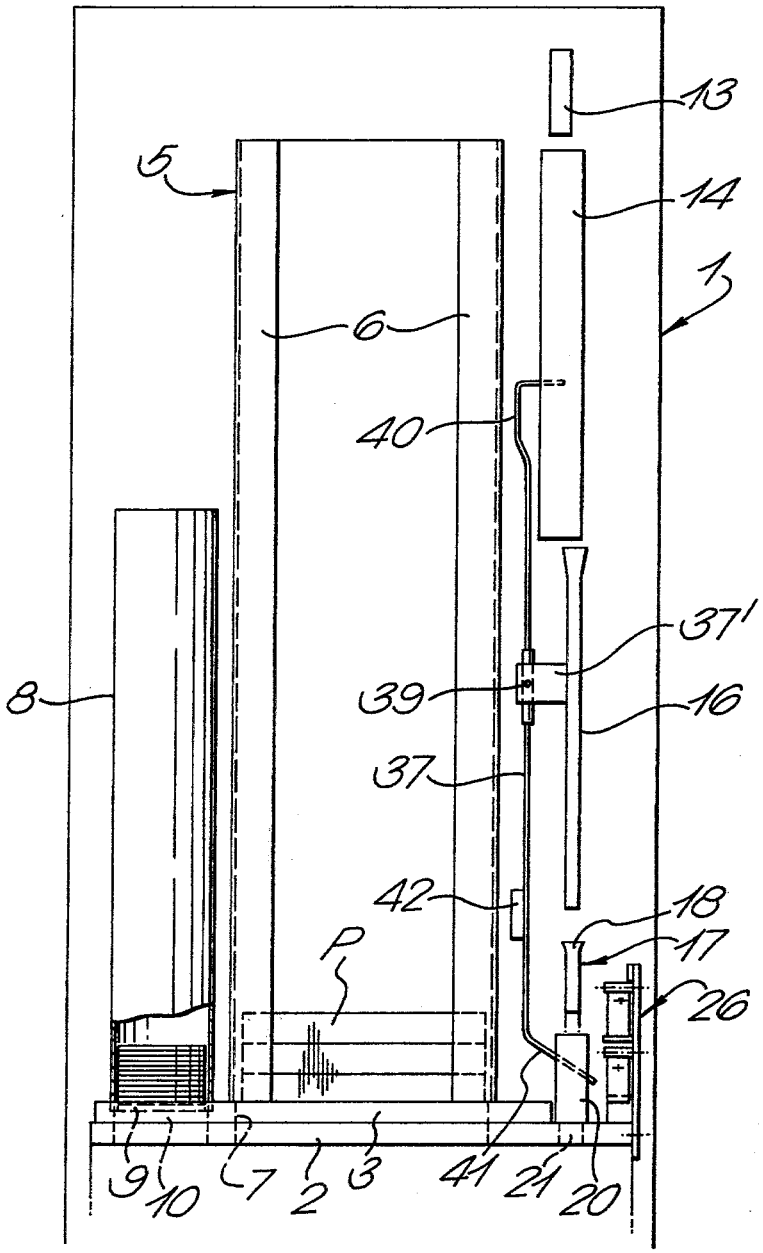
Figure 3:
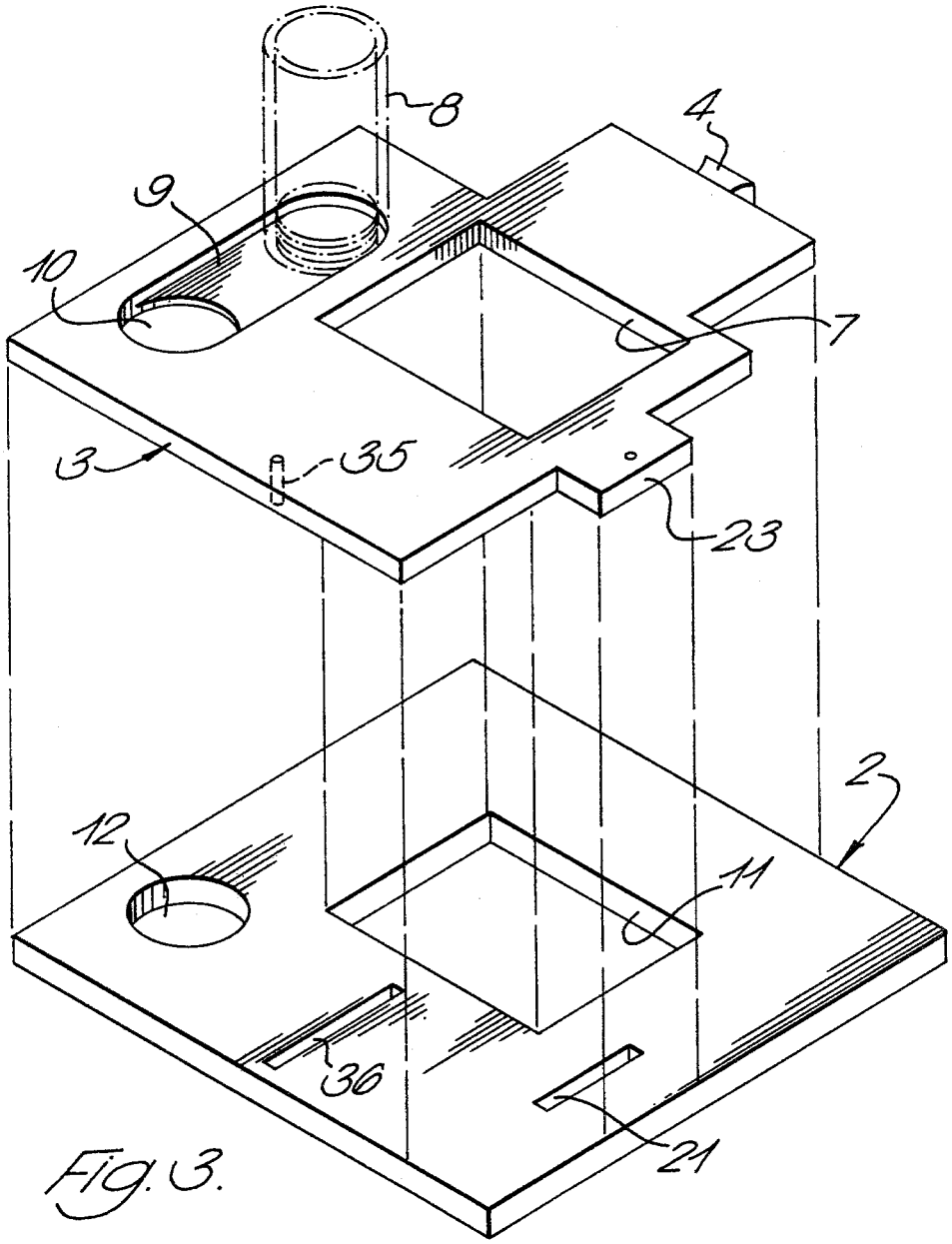
Figure 4:
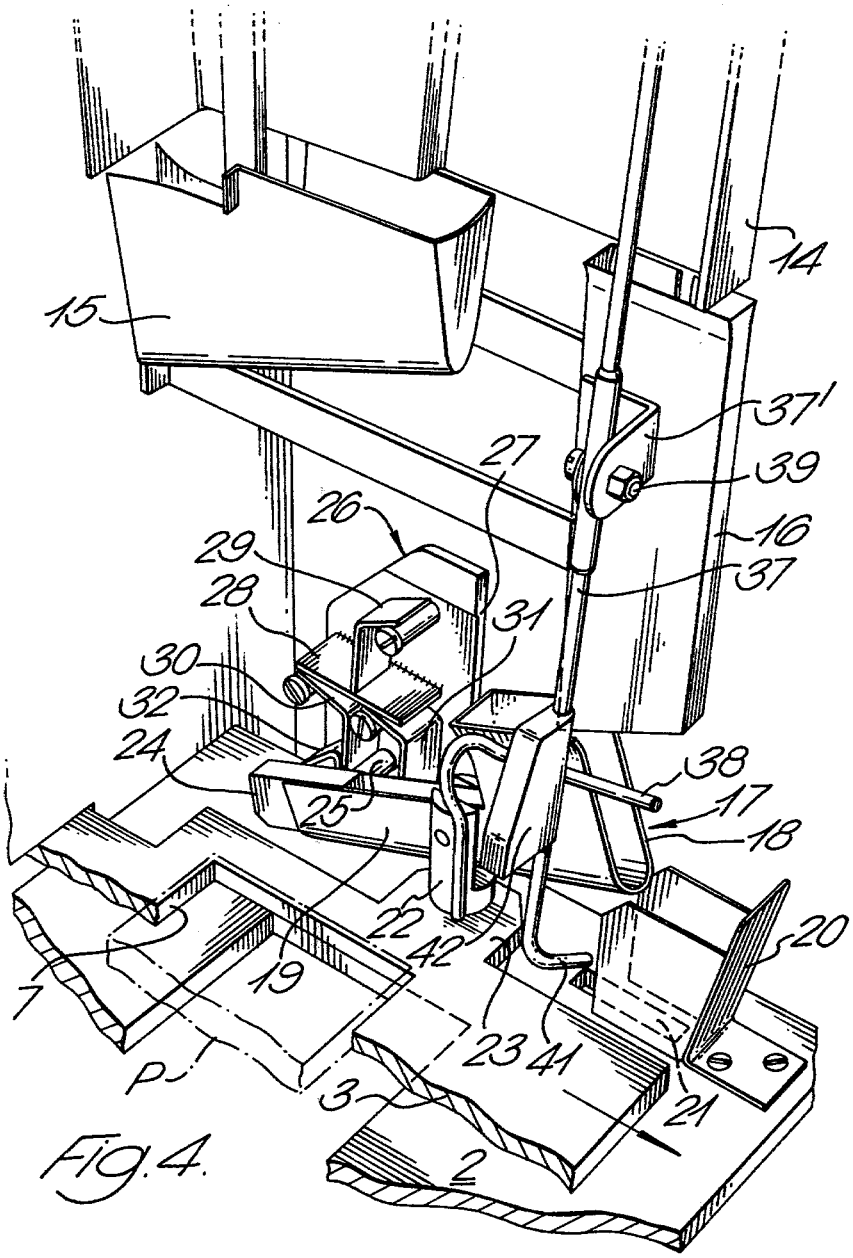
Figure 5:
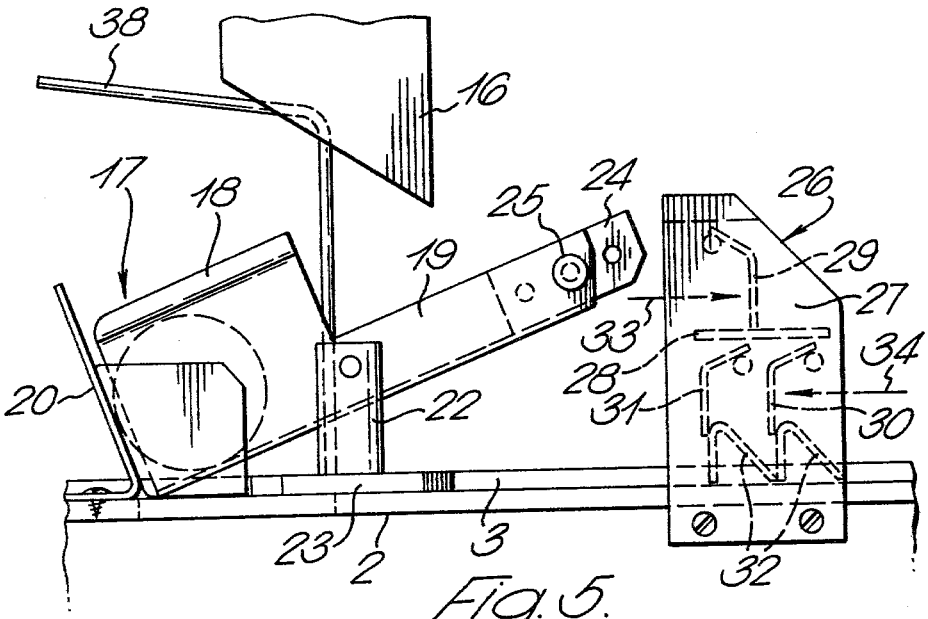
Figure 6:
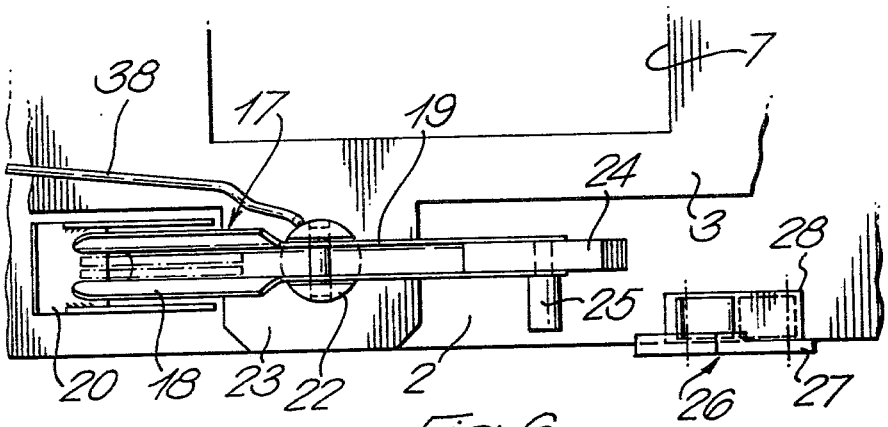
Figure 7:
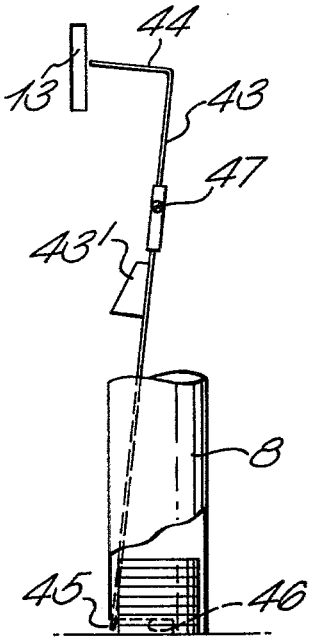
Figure 9:
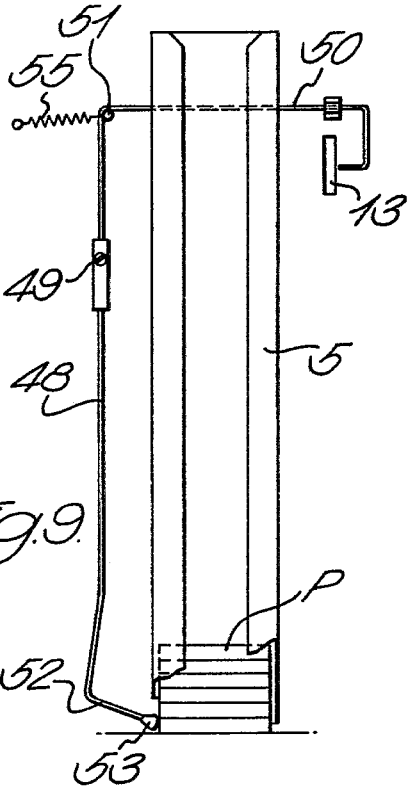
Figure 8:
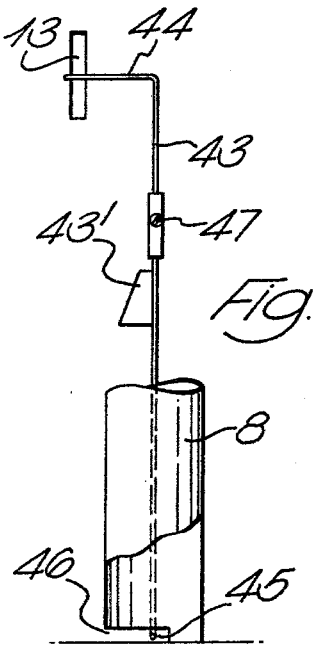
Figure 10:
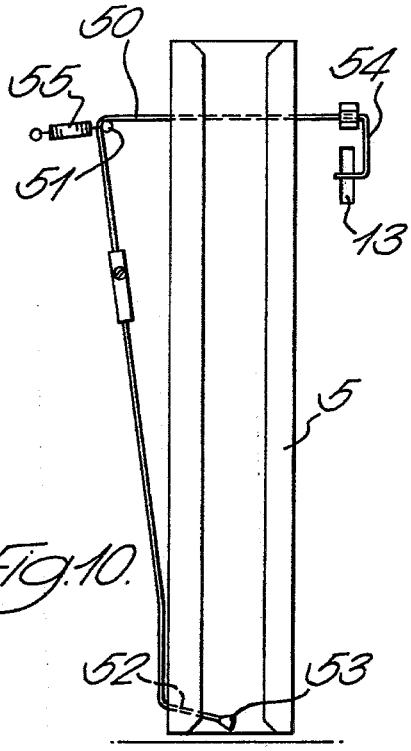
Figure 11:
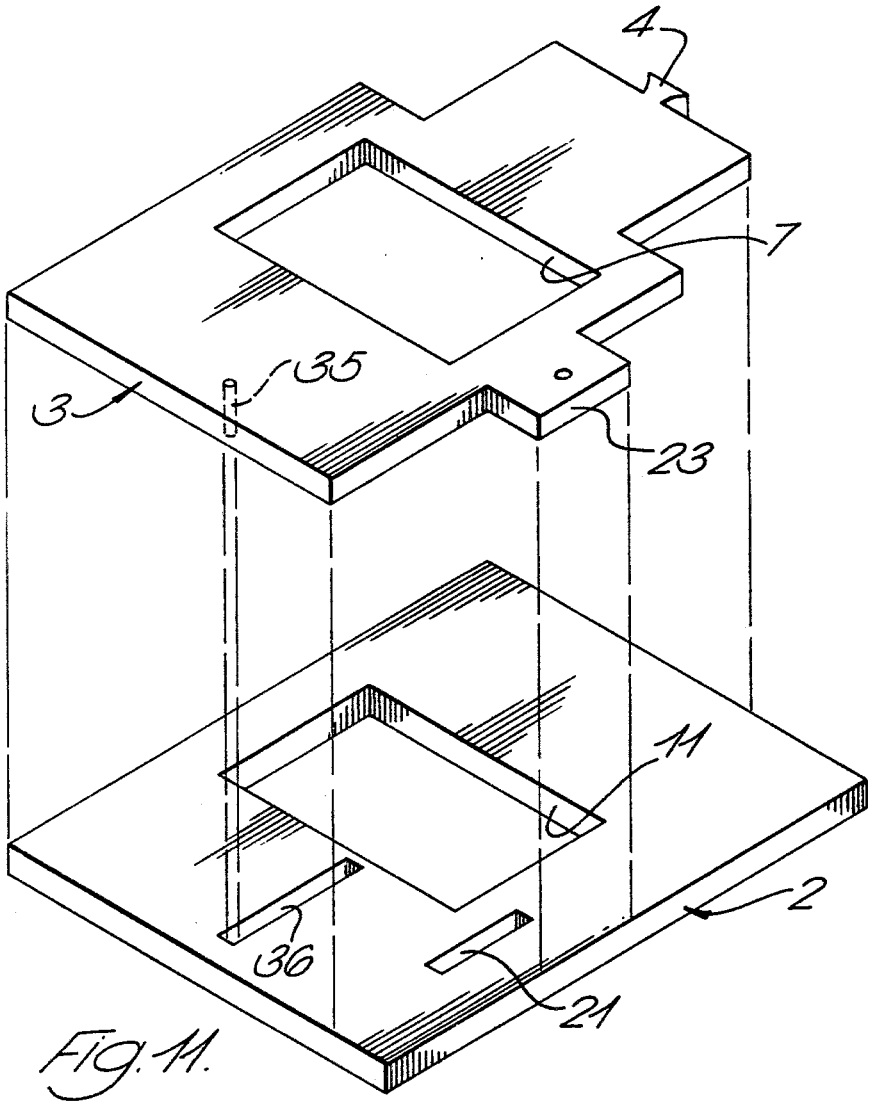

The invention is illustrated by way of example in the accompanying drawings in which, FIG. 1 is a side view of one embodiment of a coin freed vending machine according to the invention, FIG. 2 is a corresponding rear view, FIG. 3 is an exploded perspective view of the base plate and delivery slide or drawer of the embodiment of FIGS. 1 and 2, FIG. 4 is a perspective view of the coin acceptance device and adjacent parts of the embodiment of FIGS. 1 and 2, FIG. 5 is a side elevation of the coin acceptance device of FIG. 4, FIG. 6 is a plan view corresponding to FIG. 5, FIGS. 7 and 8 are schematic views showing the means for preventing coin entry when a coin storage means is empty, FIGS. 9 and 10 are schematic views showing the means for preventing coin entry when the goods storage means are empty, FIG. 11 is an exploded perspective view showing a base plate and slide or drawer for use in a vending only machine.

Figure 12:
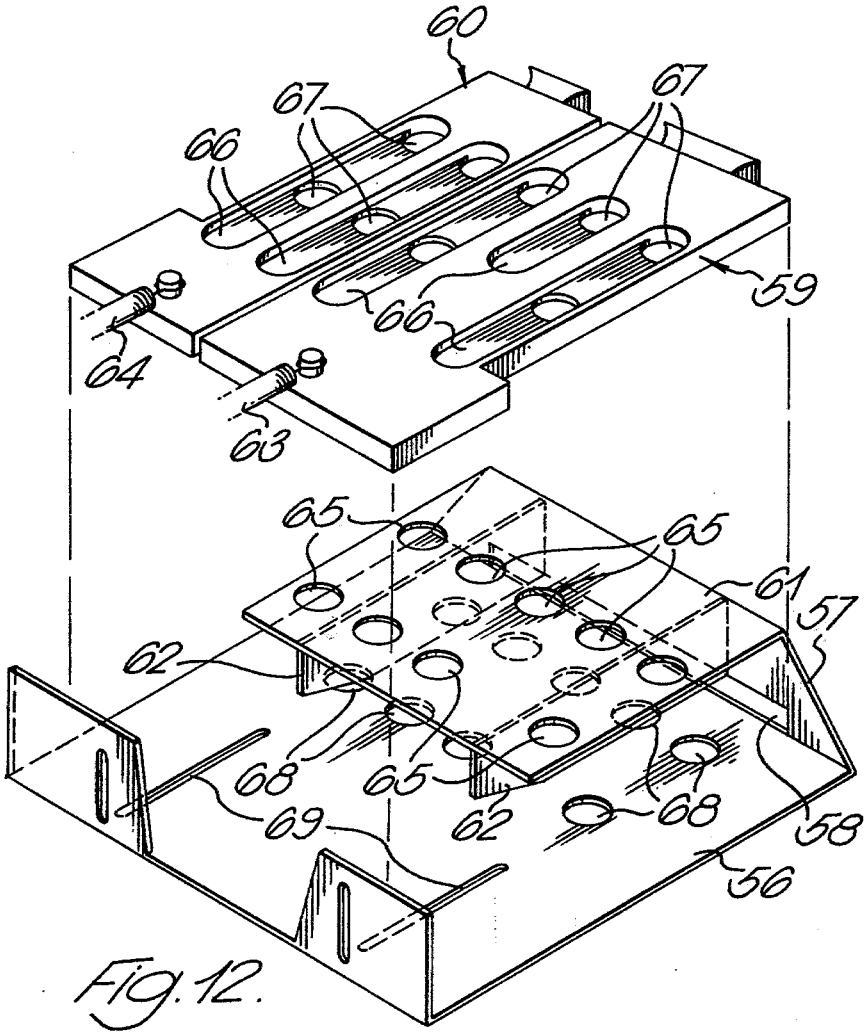
Figure 13:
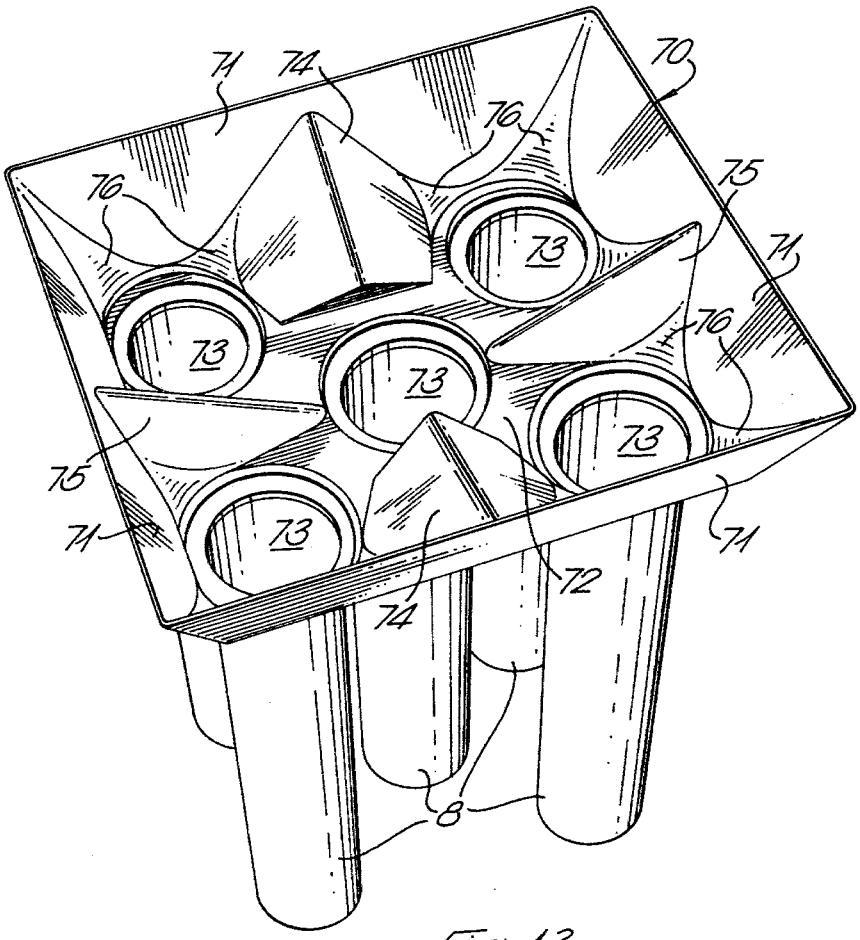

FIG. 12 is an exploded perspective view of a base plate and slide or drawer for use in a coin change machine according to the invention and FIG. 13 is a perspective view of a hopper device for use in a coin change machine.

It will be appreciated that the drawings are purely of a schematic nature to show the relative positions of the essential parts of the machine, some of which parts are not shown in all views.

Referring to FIGS. 1 to 10 of the drawings, there is shown a vending machine for delivering goods and a single coin in change. The machine comprises a frame or housing 1 supporting a base plate 2 on which is slidably mounted a slide or drawer 3 having a gripping knob or handle 4.

A vertically disposed goods storage rack 5 consisting of two inwardly facing chanel elements 6 is supported above the slide 3 so that its lowermost end is closely adjacent the upper surface of the slide. The rack 5 is adjacent to, or preferably overlaps, a goods receiving aperture 7 formed in slide 3.

Similarly, a vertically disposed coin tube 8, which provides change to be delivered simultaneously with the goods, is supported above the slide 3 so that its lowermost end is closely adjacent a milled groove 9 formed in the upper surface of the slide 3. At one end of the groove 9 is a coin receiving aperture 10. The lower end of the coin tube 8 is positioned adjacent the aperture 10.

As can be seen from FIG. 3, the base plate 2 is formed with a goods delivery aperture 11 and a coin delivery aperture 12 which correspond in position, when the slide 3 in its closed or retracted position, respectively to the apertures 7 and 10.

The machine further includes a coin entry member 13, acoin checking and receiving device 14 and a coin rejection chute 15 all of which may be standard commercially available units. A vertically disposed coin chute 16 is positioned below the device 14 to receive coins passed through the device 14 after being checked therein.

Below the coin chute 16 there is provided a coin acceptance device 17 in the form of a see-saw device having a coin bucket 18 and a control arm 19, the coin bucket being open at the top and one end to co-operate respectively with the coin chute 16 and a channel-shaped coin guide 20 fixed to the base plate 2. The coin guide 20 is open to a coin slot 21 formed in the base plate 2 through which accepted coins pass into a coin box (not shown). The control arm 19 of the see-saw device 17 is pivotally mounted on a pivot post 22 fixed to a projection 23 formed on the slide or drawer 3.

The control arm 19 is provided with a counterweight 24 the weight and/or the position of which is determined according to the weight, and thus the value, of the coin or coins to be used in a single vending operation. The control arm 19 is also provided with a transverse projection 25 which co-acts with a stop device 26 fixed to the base plate 2. As can be seen particularly in FIGS. 4 to 6, the stop device 26 comprises a vertical plate 27 having a horizontal projecting plate 28 above which is an upper gate in the form of a pivoted arm 29, and below which is a lower gate in the form of two pivoted arms 30 and 31 each co-acting with a ramp-like abutment 32.

The operation of the machine hereinbefore described will now be described with reference to vending packets P at a cost of 40 cents each by inserting two 25 cent coins into the machine and obtaining delivering of a packet P and a 10 cent coin in change. Where necessary, a dead weight may be positioned on the column of packets P to prevent any tendency for them to tilt.

In the inoperative position of the machine, the seesaw device 17 will be in the position shown in FIG. 1 where the arm 19 is lowered and the projection 25 thereof is engageable with the pivoted arm 31 to prevent the slide or drawer 3 being moved into an open position, the member 17 being held in this position by the counterweight 24.

In operation, two 25 cent coins are inserted into the coin entry member 13 in succession and pass through the coin checking and receiving device 14. If the coins are not of the correct value, or are bent or otherwise damaged, they will be returned via the coin rejection chute 15. If they are correct, they will be passed, via the coin chute 16, into the coin bucket 18. The weight of the coins will cause the device 17 to tilt so that the coin bucket 18 will be lowered and the arm 19 will be raised. In this position, the coins will be retained in the coin bucket 18 by the coin guide 20.

The slide or drawer 3 can now be pulled forward or opened since the projection 25 of the raised arm 19 can pass through the upper gate (pivoted arm 29) which operates in one direction only indicated by the arrow 33. The forward movement of the slide or drawer 3 results in the bucket 18 moving away from the coin guide 20 so that the coins will roll out of the bucket 18 into the coin box via the coin slot 21. At the same time, the goods aperture 7 will be moved into vertical alignment with the goods rack 5 and receive a packet P, and the coin delivery aperture 10 will be moved into vertical alignment with the coin tube 8 to receive the change, such as a 10 cent coin. Also at the same time, the device 17 will tilt under the action of the weight 24 so that the arm 19 is moved into its lowered position. The slide or drawer 3 can then be returned to its closed position with the projection 25 passing through the lower gate (pivoted arms 30 and 31) which operates in one direction only indicated by the arrow 34. When the slide or drawer 3 reaches its fully closed position, the coin aperture 10 will be vertically aligned with the aperture 12 in the base plate 2, and the goods aperture 7 will be vertical alignment with the aperture 11 in the base plate 2, with the result that the packet P and the 10 cent change will fall, via the respective apertures 7 and 10, into a delivery chute. At the same time, the surface of the groove 9 and the surface of the slide or drawer 3 adjacent the aperture 7 will serve respectively to block off the coin tube 8 and the goods rack 5 until the next operation.

It will be appreciated that, due to the one-way action of the upper and lower gates of the stop device 26, movement of the slide or drawer 3 is under complete control, the extent of movement of the slide or drawer being determined by a peg 35 on the slide or drawer moving in a slot 36 formed in the base plate 2. Depending on the extent of movement of the slide or drawer 3, the upper and lower gates may each be provided by one or more pivoted arms.

If, for example, the packet P was priced at 30 cents and change of 20 cents was required, further coin apertures 10 and 12 could be provided to co-act with a further coin tube 8 holding 10 cents coin so that two 10 cent coins could be delivered. Alternatively, the depth of the aperture 10 could be increased to accommodate two 10 cent coins which would be delivered from a single coin tube.

A further feature of the present invention is the provision of coin lock-out means which serve to prevent jamming of the machine if coins in excess of the number required for a single operation are inserted in the machine. These means comprise a first lock-out arm 37 pivotally mounted on a bracket 37' fixed to the coin chute 16 and second lock-out arm 38 fixedly mounted on the pivot post 22. The arm 37 is vertically disposed and is pivoted at a mid position at 39, the upper end thereof being formed in the manner of a hook 40 and the lower end thereof being angled at 41 so that it normally extends under the coin bucket 18. The arm 37 is normally retained in its inoperative position as shown in FIG. 2 by means of a counterweight 42.

In use, when the coin bucket 18 receives the required number of coins and tilts downwardly, it engages the angled portion 41 of the first lock-out arm 37 and causes the latter to move about its pivot 39 whereby the end of the hook 40 enters the coin receiving device 14 as indicated in dotted lines. This diverts any further coins which are fed into the machine to the coin rejection chute 15 and thus avoids jamming the machine. As the slide or drawer 3 is moved forward, the second lock-out arm 38, which moves with it, is positioned to engage the first lock-out arm 37 and to hold arm 37 in its operative position as hereinbefore described until the vending operation is completed.

A further feature of the present invention is shown in FIGS. 7 and 8 of the drawings and provides means for preventing a coin from being inserted into the coin entry device 13 when the coin tube 8 is empty. These means comprise a generally Z-shaped rod 43 having an upper end portion 44 positioned to enter into a transverse slot in the coin entry device 13 and a lower end portion 45 which engages the lowermost coin in the tube 8 via a slot 46. The rod 43 is mounted on a pivot 47 and is biased into a position where the end 45 of the rod is in engagement with the lowermost coin by means of a weight 43'. When the last coin is dispensed, the end 45 will move through the slot 46 and, at the same time, the end 44 of the rod will move into the slot in the coin entry device 13 thereby preventing a coin being inserted into the machine.

A still further feature of the invention is the provision of means to prevent a coin from being inserted into the coin entry device 13 when the goods rack 5 is empty. As shown in FIGS. 9 and 10 of the drawings these means comprise a vertical rod 48 mounted on a pivot 49 and a horizontal rod 50 hingedly connected at 51 to the rod 48. The lower end of the rod 48 is angled at 52 and is provided with a ball 53 which is positioned to enter into engagement with the lowermost packet P in the rack 5 through an opening in the rack 5. The free end of the rod 50 has a hook portion 54 arranged to enter a slot in the coin entry device 13. The rod arrangement 48, 50 is biased, by means of a tension spring 55, into a position where the ball 53 is urged into engagement with the packet P. When the last packet is dispensed, the action of the spring 55 will cause the end 52 of the rod 48 to move into the rack 5 and, at the same time, cause the hooked end 54 of the rod 50 to enter the coin entry device 13 thereby preventing a coin from being inserted into the machine.

FIG. 11 of the drawing show a base plate 2 and a slide or drawer 3 which have been modified to convert the machine hereinbefore described into one for vending goods only for the correct denomination of coin or coins. In this respect, it will be understood that the machine is constructed in the manner hereinbefore described, the only difference being that the change dispensing means are omitted.

In the machines hereinbefore described, the slides or drawers are operated by two manual movements, i.e. a forward movement and a return movement, the goods and, where applicable, the change being dispensed on the return movement. In a modified machine, the return movement of the slide or drawer may be effected by springs, the goods and/or coins being dispensed on the slide or drawer being moved forward. A modified slide or drawer arrangement for such a machine is shown in FIG. 12 of the drawings as applied to a change dispensing machine. The arrangement illustrated has two separate slides or drawers, one of which may dispense, for example, four 5 cent coins in exchange for two 10 cent coins, and the other of which may dispense five 5 cent coins for one 25 cent coin or five 10 cent coins for one 50 cent coin.

Referring to FIG. 12, there is shown a base plate 56, a front vertical wall 57 having a slot or opening 58 to accommodate a first slide or drawer 59 and a second slide or drawer 60, an upper support wall 61 lying parallel to the base plate 56, and a pair of stiffening flanges 62 to add rigidity to the upper wall 61. The slides or drawers 59 and 60 are biased into a closed or retracted position by means of tension springs 63 and 64 which are anchored to a fixed part of the machine.

The side or drawer 59 is arranged to dispense five coins and for this purpose the upper wall 61 is formed with five apertures 65 in which give coin tubes (not shown) are received and supported so that the lower ends thereof are closely adjacent milled grooves 66 formed in the surface of the slide or drawer 59. Three grooves 66 are shown, two of which have two co-acting coin receiving apertures 67 and the third one of which has a single coin receiving aperture 67. The positions of the coin apertures 67 are coincident with the respective apertures 65 in the upper wall 61, when the slide or drawer 59 is in its closed or retracted position. Thus, it will be seen that there is a coin tube associated with each aperture 67, and during use, when the slide or drawer 59 is moved under the action of its spring 63 into its closed or retracted positions, a coin will fall into each aperture 67 in readiness for the next dispensing operation.

Furthermore, the base plate 56 is provided with five coin dispensing apertures 68 which co-act with the respective apertures 67. However, the apertures 68 are off-set in the direction of the front wall 57 relative to the apertures 67 preferably by at least half the diameter of the apertures.

In operation when the slide or drawer 59 is pulled forward, the apertures 67 will be moved each carrying with them a coin, out of register with the apertures 65, i.e. the coin tubes, and into register with the apertures 68 whereby the coins will fall into a delivery chute. At the same time, the surfaces of the grooves 66 will move over the ends of the coin tubes to retain the coins therein. On delivery of the coins, the slide or drawer is released whereupon it is returned to its closed or retracted position under the action of its spring 63 in readiness for the next operation.

The arrangement and operation relative to the slide or drawer 60 is the same as that for the slide or drawer 59 except that there are four apertures 65 (coin tubes), two grooves 66 each having two coin receiving apertures 67 and four coin delivery apertures 68.

It will be appreciated that a separate coin receiving device 17 as hereinbefore described will be provided for each slide or drawer, the base plate 56 being formed with a coin slot 69 for each device.

In each of the embodiments described, the coin tubes are preferably supported by providing each of them with a fixed collar near the lower end thereof, the lower end passing through an aperture in a fixed support plate, for example the support 61 shown in FIG. 12, and the upper end thereof being held in a removable support plate. A plurality of coin tubes may be attached to one another in pre-selected groups and each group may include, or have attached thereto, a suitable coin hopper to facilitate filling of the tubes.

A suitable hopper for use in a change-dispensing machine having five coin tubes 8 is shown in FIG. 13 of the drawings. The hopper comprises a rectangular tray 70 having inclined walls 71 and a base wall 72. The base wall 72 is formed with five openings 73 to receive the ends of the five coin tubes 8, the openings 73 being tapered towards the tubes to facilitate movement of coins into the tubes.

Two opposite sides of the tray 7 have fixed thereto guide elements 74 of triangular cross-section which are positioned between two of the openings 73, the innermost end of each guide presenting a step of traingular formation. The other two opposite sides of the tray 70 have fixed thereto guide elements 75 of triangular cross-section. In this case, the guide elements 75 extend between two of the openings 73 and are tapered to a point adjacent the central opening 73.

The corners of the tray 70, and also the areas adjacent the guide elements 74 and 75 have filler inserts 76 so that the walls 71 and the guide elements 74 and 75 merge towards the openings 73.

It has been found in practice that, by using the hopper hereinbefore described, a bag of coins can be emptied into the hopper and caused to fill the tubes 8 without any tendency to jam.

In an alternative form of slide or drawer, instead of forming milled grooves in the surface of the slide or drawer, it may be formed from two interconnected plates, one of which is provided with the coin receiving apertures, and the other of which has stamped out slots which correspond to the milled grooves.

With regard to the coin acceptance device 17, the weight 24 is provided to be adjustable to cater for different values and/or numbers of coins. Thus, as shown in FIG. 5, the weight may be drilled and tapped to receive, in one of a plurality of positions, the projection 25 which is screw-threaded at one end. In another arrangement, the weight may have a single tapped hole to receive the projection which is slidable in a slot in the arm 19 to effect adjustment.

Although the embodiments described make reference to the use of specific denominations of coins, it will be appreciated that the figures given are not limititive. Thus, other combinations and values may be used to suit requirements. In this respect, it is preferred that the coin bucket 18 be made of a size suitable to receive at least two 50 cent coins or a plurality of coins of other denominations.

Also, in order to avoid making a number of different base plates and slides or drawers to suit different requirements, one base plate and one slide or drawer could be made each with a predetermined number of apertures and the number and value of coins dispensed could be varied by providing a selected number of coin tubes co-acting with selected apertures thereby leaving the remaining apertures as blanks.

Although the invention has been described primarily with reference to machines which are wholly mechanical, it will be obvious that it is not limited in this respect. Thus, the coin acceptance device 17 and its co-acting stop device 26 may be applied to any type of machine which has a movable slide or drawer to effect delivery of goods and/or coins. In this respect, in electronic or electro-mechanical machines, the movement of the see-saw device could be used to actuate switches or the like to operate coin lock-out and other safety or security devices.

Furthermore, it will be obvious that numerous combinations other than those described can be provided. Also, where it is found preferable to use other forms of coin checking and receiving devices, for example, one where the coin outlet is toward the front of the machine, the positions of the coin acceptance device and its co-acting stop means may be reversed.

It will also be obvious that, although only FIG. 12 has been described with reference to a change-dispensing machine, the embodiment of FIGS. 1 to 6 may be modified to provide a change-giving machine thus providing a machine where the change is delivered where the slide or drawer is returned to its fully closed position.

I claim:

1. A coin freed vending machine, comprising storage means for items to be dispensed, delivery means for dispensing said items, and a coin acceptance device co-acting with a stop device to provide anti-cheat means, where-in said coin acceptance device comprises a see-saw member having a coin bucket mounted on one end of a control arm, said control arm being tiltable and positioned to co-act with said stop device to control movement of said delivery means, said stop device having first gate means to permit passage therethrough of a part of said control arm in one direction only, and second gate means to permit passage therethrough of said part of said control arm in the opposite direction only.

2. A machine as claimed in claim 1, in which said coin bucket is open at the top and one end and co-acts with a coin guide which holds coins in position therein during a part of the cycle of the machine.

3. A machine as claimed in claim 2, in which the end of the control arm opposite said coin bucket is provided with a counterweight the weight of said counterweight, being dependent upon the weight of the coins used in a particular operation.

4. A machine as claimed in claim 3, in which said counterweight is adjustably mounted on said control arm.

5. A machine as claimed in claim 1, in which the said part of the control arm which co-acts with said stop device comprises a transverse projection.

6. A machine as claimed in claim 5, in which said first gate means of said stop device comprises at least one pivoted arm, said pivoted arm being constrained to permit movement of said transverse projection of said control arm in one direction only.

7. A machine as claimed in claim 6, in which said second gate means of said stop device comprises at least one pivoted lever, said lever being constrained to permit movement of said transverse projection of said control arm in one direction only.

8. A machine as claimed in claim 1, including coin lock-out means to prevent jamming of the machine with coins in excess of requirements.

9. A machine as claimed in claim 8, in which said lock-out means comprise a first lock-out arm co-acting with said coin bucket and a coin receiving device, and a second lock-out arm which co-acts with said first lock-out arm and is fixed to and movable with said delivery means.

10. A machine as claimed in claim 9, in which said first lock-out arm is biased into an inoperative position.

11. A machine as claimed in claim 1, in which said coin storage means comprise at least one vertically disposed tube.

12. A machine a claimed in claim 11, including means to prevent the insertion of coins into the machine when a coin tube is empty.

13. A machine as claimed in claim 12, in which means comprise a generally Z-shaped pivoted rod one end of which is positioned to enter a transverse opening in a coin entry device and the other end of said rod one end being adapted to enter a transverse slot at the base of said coin tube, means being provided to bias said rod into a position where the respective ends thereof enter said coin entry device and said slot in the coin tube.

14. A machine as claimed in claim 1, in which said goods storage means comprise a vertically disposed storage rack.

15. A machine as claimed in claim 14, including means to prevent the insertion of a coin into the machine when said goods storage rack is empty.

16. A machine as claimed in claim 15, in which said means comprise a vertically disposed pivoted rod and a horizontally disposed slidable rod hingedly connected to each other at adjacent ends, the free end of said vertical rod being positioned to enter an opening in said storage rack and the free end of the horizontal rod being positioned to enter a transverse opening in a coin entry device, means being provided to bias the respective rod ends into positions where they enter said openings in said goods storage rack and said coin entry device.

17. A machine as claimed in claim 1, including a plurality of coin tubes, and wherein a hopper is provided to facilitate filling said tubes with coins of the same denomination.

18. A machine as claimed in claim 17, in which said hopper comprises a rectangular tray having inclined walls and a base wall formed with a plurality of openings to receive a corresponding number of coin tubes, the interior of said walls having guide elements of triangular cross-section to guide the coins towards said openings.

* * * * *